United States Patent [19]

Campbell et al.

[11] Patent Number: 4,917,268

[45] Date of Patent: Apr. 17, 1990

[54] LIQUID DISPENSING PACKAGE WITH DRAINBACK SPOUT

[75] Inventors: G. Edward Campbell, Pleasanton, Calif.; Vincent R. Lomax, Mesa, Ariz.; Jack Buelow, Danville; Mark T. Hanses, San Ramon, both of Calif.

[73] Assignee: The Clorox Company, Oakland, Calif.

[21] Appl. No.: 209,221

[22] Filed: Jun. 20, 1988

[51] Int. Cl.[4] ..... B67D 1/16

[52] U.S. Cl. ..... 222/109; 222/153

[58] Field of Search ..... 222/108–109, 222/111, 153, 481, 488–489, 544–545, 548–549, 551, 570–571; 215/218, 221, 330

[56] References Cited

U.S. PATENT DOCUMENTS

| | | | |
|---|---|---|---|
| 2,061,685 | 11/1936 | Wheaton | 221/147 |
| 2,601,039 | 6/1952 | Livingstone | 222/109 |
| 2,601,040 | 6/1952 | Livingstone | 222/109 |
| 2,715,480 | 8/1955 | Livingstone | 222/111 |
| 2,743,844 | 5/1956 | Livingstone | 222/111 |
| 2,763,403 | 9/1956 | Livingstone | 222/111 |
| 3,201,014 | 8/1965 | Livingstone | 222/545 |
| 3,300,104 | 1/1967 | Burt | 222/482 |
| 3,369,710 | 2/1968 | Lucas | 222/109 |
| 3,628,697 | 12/1971 | Dowson | 222/111 |
| 3,833,150 | 9/1974 | Visser-Patings | 222/109 |
| 4,078,700 | 3/1978 | Hidding | 222/109 |
| 4,218,189 | 12/1978 | Baxter | 222/109 |
| 4,273,247 | 6/1981 | Earls | 215/228 |
| 4,298,129 | 11/1981 | Stull | 215/224 |
| 4,298,145 | 11/1981 | Iida | 222/478 |
| 4,349,056 | 9/1982 | Heino | 141/381 |
| 4,494,682 | 1/1985 | Beckstrom et al. | 222/551 |
| 4,533,058 | 8/1985 | Uhlig | 215/216 |
| 4,550,862 | 11/1985 | Barker et al. | 222/109 |
| 4,600,131 | 7/1986 | Roof et al. | 222/478 |
| 4,671,421 | 6/1987 | Reiber et al. | 215/228 |
| 4,696,416 | 9/1987 | Muchenfuhs et al. | 222/109 |
| 4,706,829 | 11/1987 | Li | 215/354 |
| 4,773,560 | 9/1988 | Kittscher | 222/109 |

FOREIGN PATENT DOCUMENTS

| | | | |
|---|---|---|---|
| 0214675 | 3/1987 | European Pat. Off. . | |
| 0255062 | 2/1988 | European Pat. Off. . | |
| 3207223 | 9/1983 | Fed. Rep. of Germany . | |
| 51-129658 | 10/1976 | Japan . | |
| 50-51342 | 11/1977 | Japan . | |
| 106092 | 4/1965 | Norway | 222/153 |

*Primary Examiner*—Michael S. Huppert

*Attorney, Agent, or Firm*—Majestic, Parsons, Siebert & Hsue

[57] ABSTRACT

A dispensing package is provided that includes a liquid container and a drainback spout fitment fitted within a dispensing opening in a finish at the upper end thereof. A measuring cup is threadedly engageable with the fitment and finish to enable closing off of the container. The fitment includes a frustoconical downwardly depending side wall surrounding and spaced from the spout. A drainback channel between the spout and side wall drains back drips to a drain opening and thence into the liquid container. An interlock and centering means is provided between the finish and fitment to center the fitment with respect to the finish to assist the sealing system in preventing leaks as well as to prevent rotation of the fitment when the cup is rotated out of engagement for removal.

19 Claims, 6 Drawing Sheets

LIQUID DISPENSING PACKAGE WITH DRAINBACK SPOUT

FIELD OF THE INVENTION

This invention is directed to an improved dispensing package for liquids. In particular, the invention is directed to such a package having a measuring cup closure and drainback pouring spout.

DESCRIPTION OF RELATED ART

A significant amount of work has been done with the object of eliminating or at least greatly reducing dripping of liquid dispensing containers. This dripping is both wasteful in terms of lost liquid product but also may be messy.

An example of an early attempt to solve this dripping problem is found in the disclosure of U.S. Pat. No. 2,601,039 to Livingstone which issued on June 17, 1952. The subject patent describes a pouring adapter having an extended pouring spout. An open longitudinal slot is included on a rear surface portion. The spout has a circumscribing, inclined drainback surface, the purpose of which is to channel and direct drips or spilled liquid back into the container. In this manner, the drips or spills are salvaged. A cooperating cap is also provided and received on the adapter.

U.S. Pat. No. 4,273,247 which issued to Earls on June 16, 1981, discloses another dispensing container of interest. With this device a cap closure assembly having internal threads which mate with external threads on the container finish is provided. With this device any residual liquid that remains in the cup after dispensing may drip over the threads and thence the outside of the container.

In an attempt to solve this problem, U.S. Pat. No. 4,550,862 to Barker, et al. issued on Nov. 5, 1985, provides a transition collar on the container finish having internal threads. The dispensing cap closure has corresponding external threads therearound which mate with the internal threads. In this manner, any residual liquid in the cup will flow down the threads within the transition collar and be collected by means of a transverse partition below the threads. The thus collected liquid will thereupon flow back into the container through a drain.

In spite of the above-described patented advances, problems remain. One such problem is that the various mating parts of the dripless dispenser container exhibit leakage. This requires expensive solutions such as maintaining close manufacturing tolerances. It may also require additional parts such as seals or manufacturing process steps such as adding sealing compounds. All of this adds to cost and complexity.

SUMMARY AND OBJECTS OF THE INVENTION

It is therefore the primary object of this invention to attempt to eliminate the aforementioned problems.

It is another object of the invention to provide a liquid dispensing package having a drainback feature which prevents unwanted dripping and loss of liquid.

It is a further object to provide such a liquid dispensing device which has fewer parts and is easily fabricated.

It is a still further object to provide such a device that accommodates misalignment and substantially eliminates leakage between mating parts.

Further and other objects and advantages will become more readily apparent from a review of the following description and claims.

In a preferred embodiment of the invention, a dispensing package is provided. The package comprises a liquid container having a finish with an opening at the upper end thereof. A drainback spout fitment is fitted within the finish opening. The spout fitment includes a frustoconical spout and a downwardly directed frustoconical sidewall surrounding and spaced from the spout. An angled transition wall forms a drainback channel between the spout and the frustoconical side wall for draining back drips to a drain opening whence they flow back into the container. An interlock and centering means is also provided between the finish and fitment which centers the two parts with respect to each other to center and align the parts and thereby assists the sealing system in preventing leaks. The interlock and centering means also serves to prevent rotation of the fitment when a measuring cup which is also included with the package is rotated out of engagement for removal. Alternate embodiments of the spout fitment are also provided showing different sealing means.

DETAILED DESCRIPTION

Figure 1:
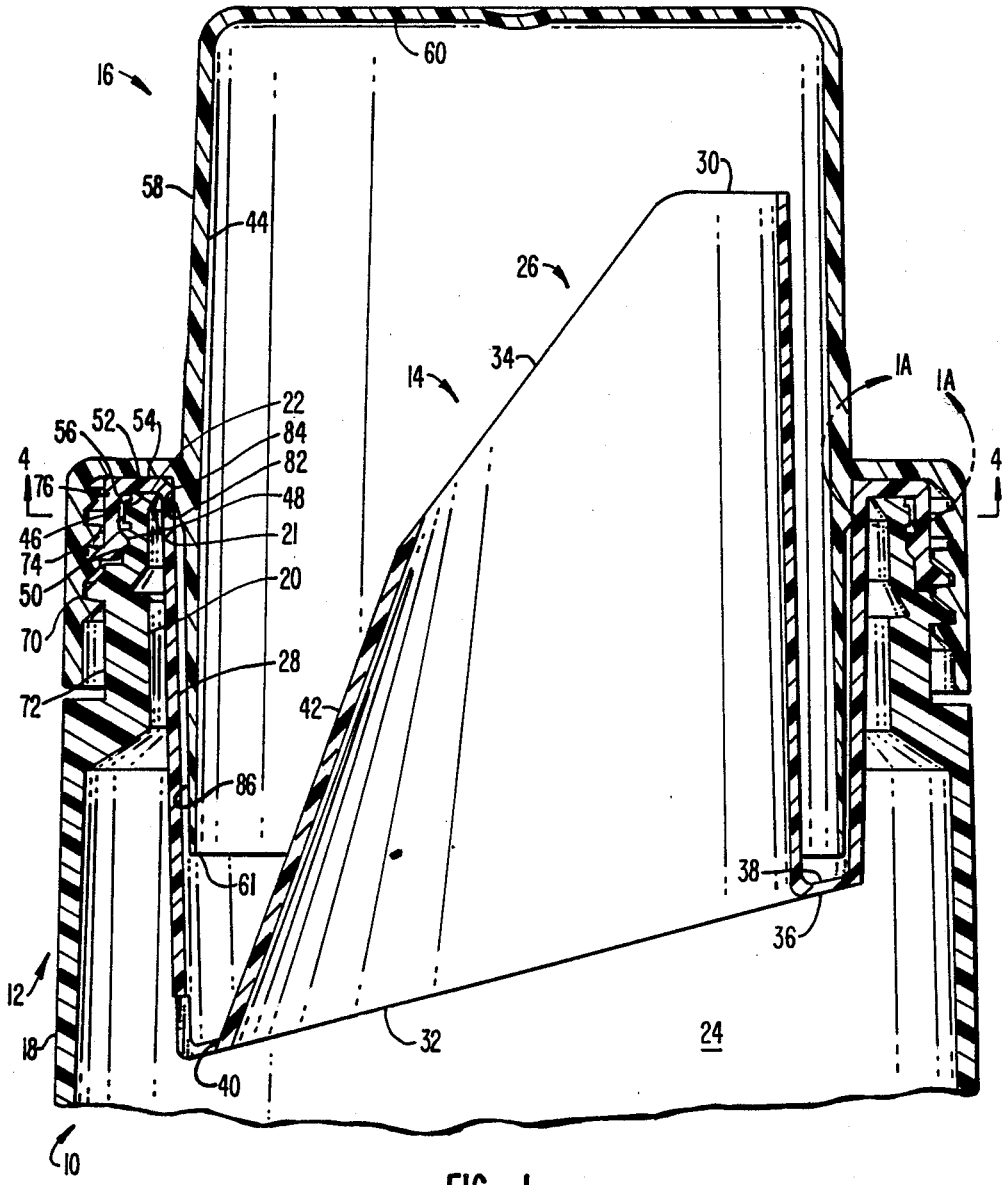
FIG. 1 is a fragmentary front elevational view in cross-section of the inventive liquid dispenser package.

Turning to the drawings, there is shown at FIG. 1 a preferred embodiment of the inventive package generally at 10. Package 10 comprises generally a hollow liquid container shown at 12, a spout fitment generally at 14, and a measuring cup generally at 16 as will be more fully described hereinafter.

Container 12 may be conveniently made of a polyolefin such as high-density polyethylene plastic material. The container has a body portion 18 and an upwardly extending finish 20 having an opening 21 in the upper end thereof An end wall 22 is provided at the upper end for sealing. Body portion 18, including that which is not shown, may be of any suitable configuration so as to provide a closed-end chamber 24 for receiving liquids to be dispensed.

Figure 7:
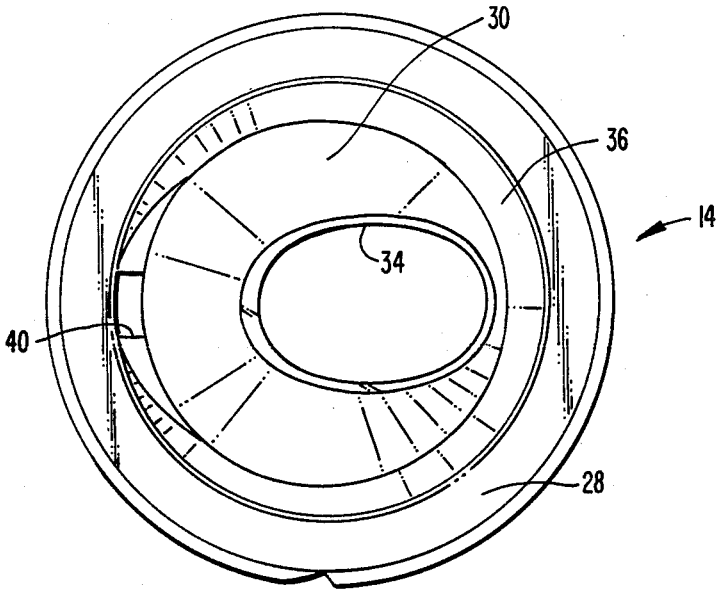
FIG. 7 is a top plan view taken along lines 7—7 in FIG. 3 and showing the spout fitment.

Fitted within the opening 21 is a spout fitment 26 which may be made of an injection-molded polyolefin such as low-density polyethylene plastic material. Fitment 26 is comprised of a downwardly directed frustoconical, inwardly sloping side wall 28 and an interiorally spaced frustoconical spout 30 for dispensing liquids. Spout 30 has an inlet opening 32 in communication with chamber 24 and an outlet opening 34. Connecting spout 30 with side wall 28 is an angled transition wall 36, as best seen in FIG. 7. Returning to FIG. 1, the conjunction of side wall 28, spout 30 and transition wall 36 forms an annular channel 38 at a downwardly sloping angle to the horizontal which functions to drain back drips and other spills through vent and drain opening 40 located at the lowermost point of channel 38. Channel 38 will function not only to drain back drips on the exterior wall surface 42 of spout 30 but also the residue left on the interior wall surface 44 of measuring cup 16, which drains down side wall 28.

Radially outward of side wall 28 is a depending annular skirt 46 having an interior annular bead 48 which mechanically mates with an accommodating groove 50 on the exterior of finish 20. Of course, the location of the bead and groove could be interchanged with equivalent results. Skirt 46 is joined to side wall 28 by means of a radially directed flat annular flange 52 having sealing surfaces 54, 56 on the upper and lower sides thereof. Lower sealing surface 56 sealingly mates with end wall 22 of finish 20.

Turning to measuring cup 16, it may be made of an injection-molded polyolefin such as polypropylene plastic material. The cup comprises a generally cylindrical side wall 58 having a generally planar bottom wall 60 closing one end. The other end defines an opening 61. As may be seen, the cup 16 functions not only to measure liquid to be dispensed when it is removed and inverted, but also to act as a cap closure for the container 12 when it is fully engaged on the container.

Figure 3:
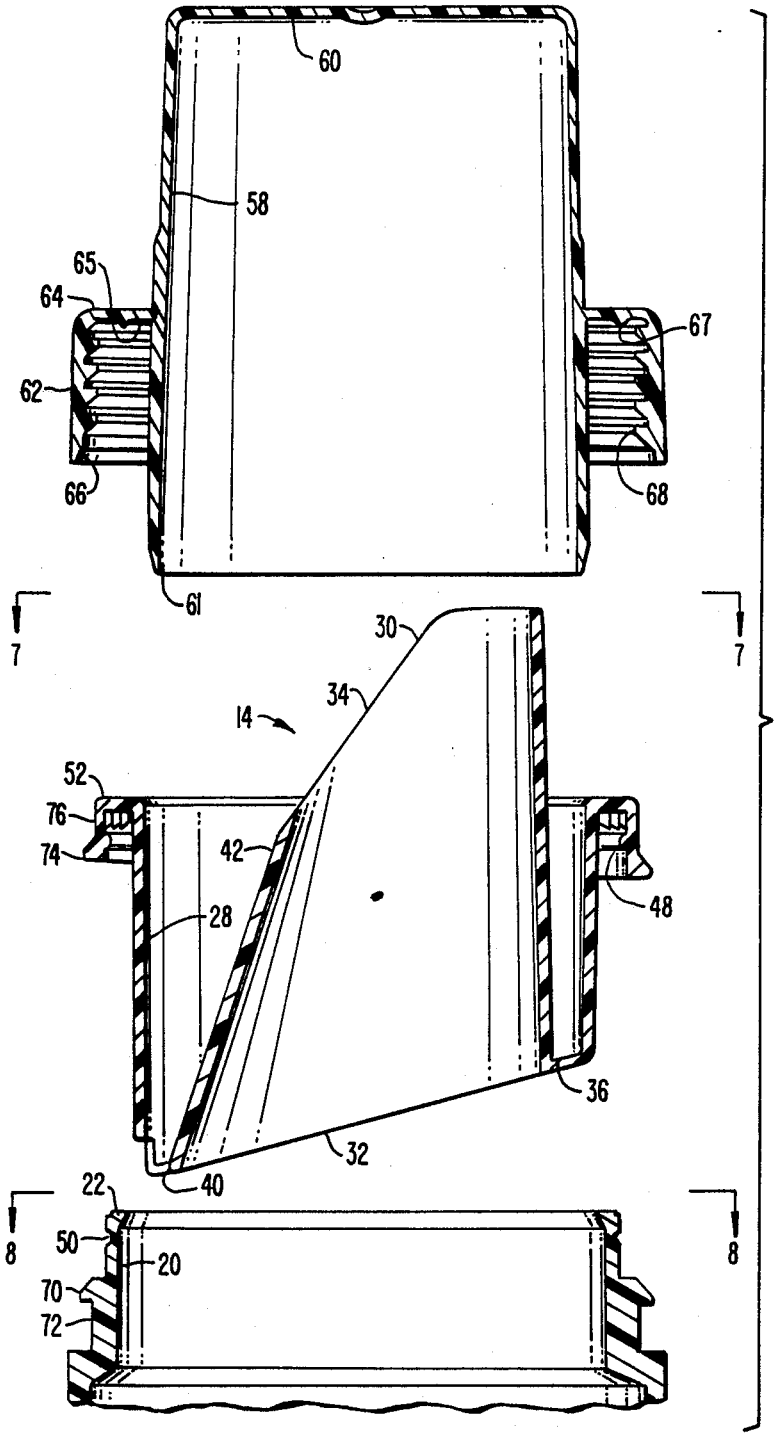
FIG. 3 is a fragmentary, exploded front elevational cross-sectional view of the liquid dispenser package of FIG. 1.
Figure 1A:
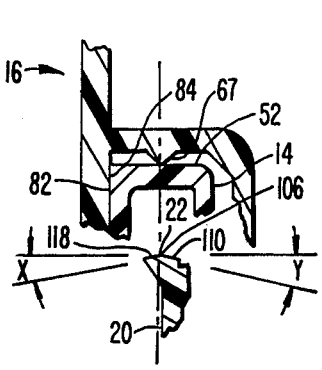
FIG. 1A is a partial cross-sectional detail view taken along lines 1A—1A in FIG. 1.

As best seen in FIG. 3, radially outward of side wall 58 is a depending skirt 62. This skirt is integrally connected to side wall 58 by means of a radially directed annular flange 64 having a lower sealing surface 65 located intermediate the closed end 60 and the open end 61 of the cup 16. A sealing bead of a convenient shape such as "V"-shaped annular ridge 67 is molded into the lower sealing surface 65 of flange 64. This "V" ridge is aligned with flange 52 of fitment 14 and end wall 22 of finish 20 so that a concentrated sealing force is produced as best seen in FIG. 1A. Also assisting in concentrating the force is the provision of a pair of bevel angles X, Y on end wall 22 of finish 20. The bevel angles X and Y may conveniently be 2° and 8°, respectively. Located on the interior wall 66 of skirt 62 are a plurality of threads 68 which produce this force when the cup 16 is rotated onto the container and the threads are interengaged.

Returning to FIG. 1, threads 68 interengage with corresponding threads 70 on the outer wall 72 of finish 20. Threads 68 also interengage with thread 74 on bottom periphery of the outer wall 76 of skirt 46.

Figure 2:
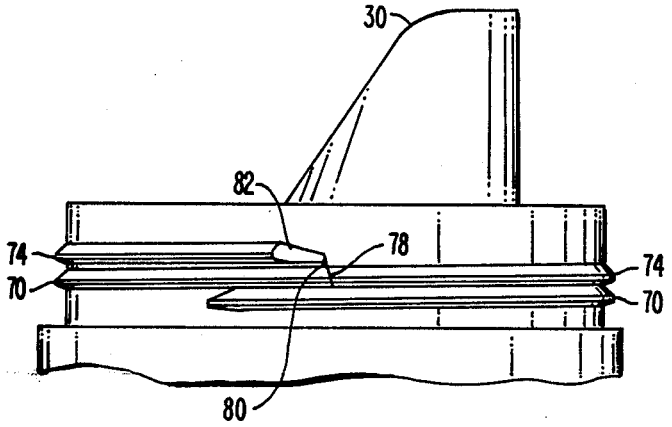
FIG. 2 is a fragmentary front elevational view of the liquid dispenser container with spout fitment thereon.

As seen in this Figure and in FIG. 2, threads 70 cooperate with thread 74 to provide a continuous thread to interengage with the cup threads (not shown). As shown in FIG. 2, thread 70 ends with an end surface such as angled end surface 78 which abuts an accommodating end surface such as angled end surface 80 on thread 74. Thread 74 makes just a single circumference of fitment 26 and stops adjacent to its starting flat surface 82 although it could make more or fewer turns. Threads 70 make slightly more than one circumference of finish 20 as shown although it could be longer or shorter as well. This abutment 78 has an additional function of orienting the fitment 26 and spout 30 thereon with respect to the liquid container 10, which may have a handle (not shown). It also functions to prevent rotation of fitment 26 with respect to finish 20 when cup 16 is rotated into its fully engaged position wherein it serves as a cap closure for the container.

Returning to FIG. 1, cup 16 is shown in its fully engaged position wherein it serves as a cap closure for container 10. In this fully-engaged position, outer wall surface 82 of side wall 58 of cup 16 is in contact with inner wall surface 84 of side wall 28 of fitment 14. The thus contacting surfaces of cup 16 and fitment 14 are closely fitted so that centering is produced therebetween. This centering of the cup with respect to the fitment also centers the threads 68 with respect to threads 70, 74 for equal force distribution around the circumference when the cup 14 is fully rotationally engaged. This produces an even distribution of forces between upper and lower sealing surfaces 54, 56 so that "V" ridge 67 is evenly compressed. The remainder of the outer wall surface 86 is tapered and spaced from inner wall surface 82.

Figure 4:
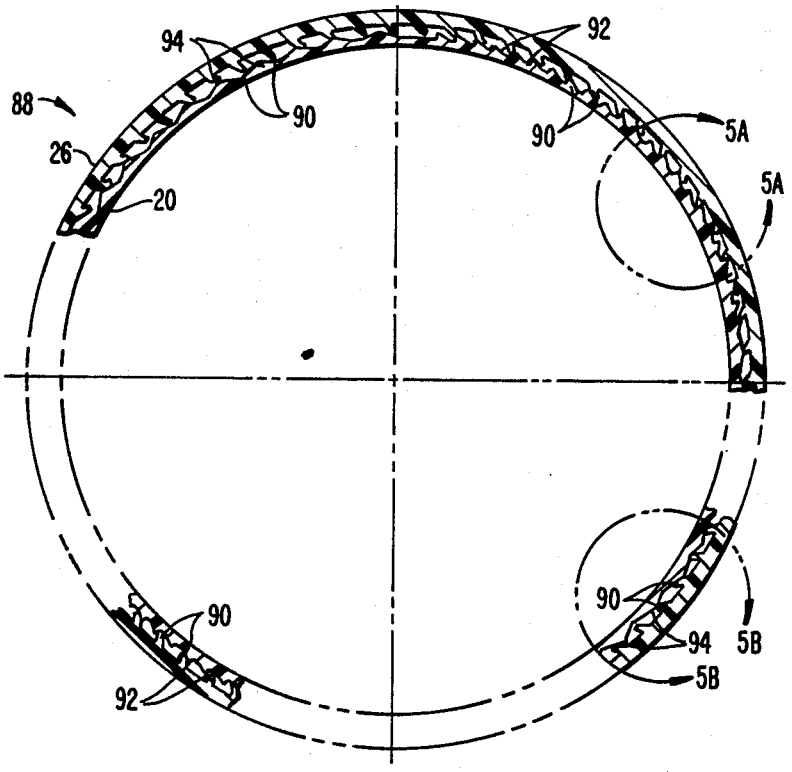
FIG. 4 is a fragmentary cross-sectional view taken along lines 4—4 in FIG. 1 and showing details of interengagement between the container finish and spout fitment.
Figure 5A:
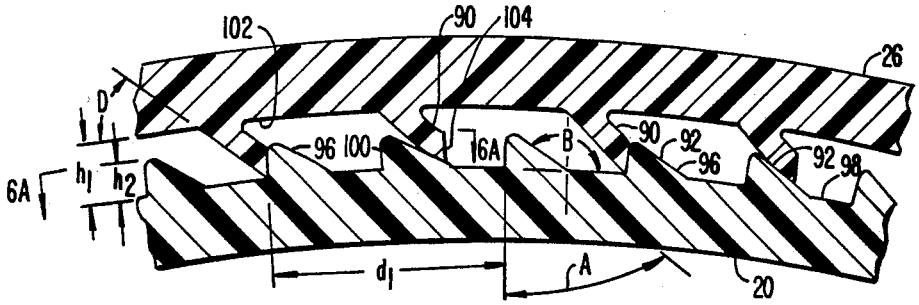
FIG. 5A is an enlarged partial cross-sectional detail view taken along lines 5A—5A in FIG. 4.

Turning to FIG. 4, a preferred embodiment of an interlock and centering means 88 comprises a plurality of locking teeth 90 and ramps 92, 94 integrally molded into the finish 20 and fitment 26, respectively. The interlock and centering means is provided for a first purpose of preventing rotation of the fitment 26 with respect to said finish 20 when the cap (not shown) is rotated off the container. As may be seen in FIGS. 5A and 5B, the ramps in opposite quadrants have two shapes. The first is a one-sided ramp 92 as perhaps best seen in FIGS. 5A and 6A. These one-side ramps have a leading edge wall 96 which are at an obtuse angle B to a tangent to the side wall 98 of finish 20. The obtuse angle B may conveniently be 150°. The trailing edge wall 100 is radially directed to a tangent to side wall 98 of finish 20. This angle may conveniently be 90°. The included angle A between leading edge wall 96 and trailing edge wall 100 may conveniently be 60°.

Teeth 90 are generally rectangular and projecting from the inner wall surface 102 of fitment 26. These teeth in their normal, undeformed state project at an angle D which may conveniently be 45° to a tangent to inner wall surface 102. Each of the teeth includes a radially directed end wall 104 which is adapted to contact and stop against a trailing edge wall 100. In this manner rotation in one direction is prevented. As may be seen, the teeth and ramps are evenly spaced so that the twice distance d1 between every tooth is substantially equal to one-and-one-half times the distance d2 between each one-sided ramp 92. To put it another way, there are three ramps for every two teeth. Other ratios and spacings are also possible. As for spacing, the teeth and ramps are so spaced such that the contact of teeth to ramps produces the interlock and centering function. It does this by having teeth contact the leading edge, trailing edge, or apexes of ramps at sufficient points about the circumference of the fitment and finish.

The radial height h1 of each tooth is substantially equal to the distance between side wall 98 of finish 20 and wall surface 102 of fitment 26. The radial height h2 of one-sided ramps 92 is less so that teeth 90 may flex and deform and pass over ramps 92 as the fitment 26 attempts to be relatively rotated to the left with respect to the finish 20 as viewed in the drawing of FIG. 5A. The ratio of height h1 to h2 may conveniently be 4 to 3.

Figure 5B:
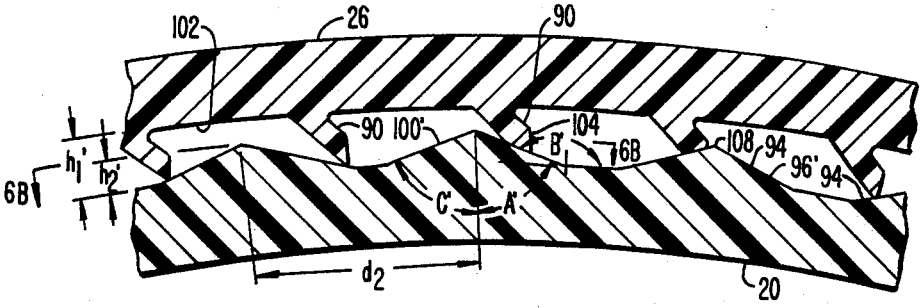
FIG. 5B is an enlarged partial cross-sectional detail view taken along lines 5B—5B in FIG. 4.
Figure 6A:
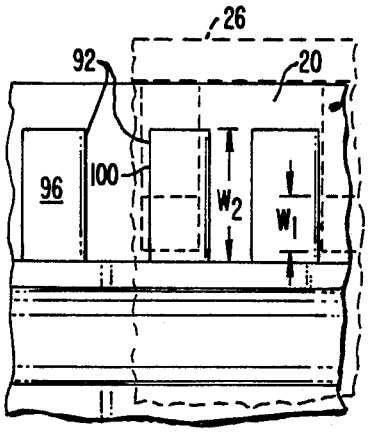
FIG. 6A is an enlarged detail view taken along lines 6A—6A in FIG. 5A.
Figure 6B:
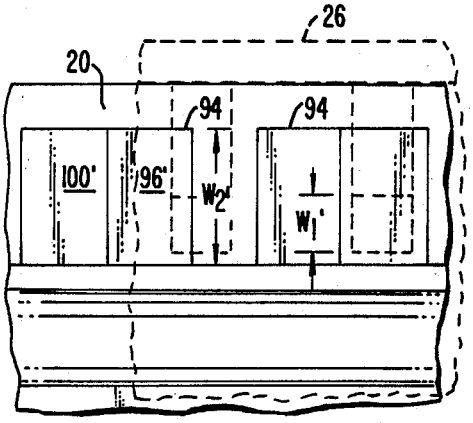
FIG. 6B is an enlarged detail view taken along lines 6B—6B in FIG. 5B.

Turning to the remaining two opposite quadrants as represented by FIGS. 5B and 6B, the teeth 90 remain the same so need no further discussion. However, the ramps 94 are shown to be two-sided. Again, they have a leading edge wall 96'. They also have a trailing edge wall 100' which is also at an angle. The two acute angles A' and C' between the radial direction and the respective walls 96' and 100' may be equal and may conveniently be 70°. The obtuse angle B' may conveniently be 160°. The radial height h1' equals radial height h1. The radial height of each tooth h1' bears a ratio of 2 to 1 with respect to the height of each two-sided ramp 94. As may be seen in FIGS. 6A and 6B, the one- and two-side ramps 92, 94, respectively, may be of equal width w2, w2'. Teeth 90 can have a shorter width w1, w1' which may both be equal.

Figure 8:
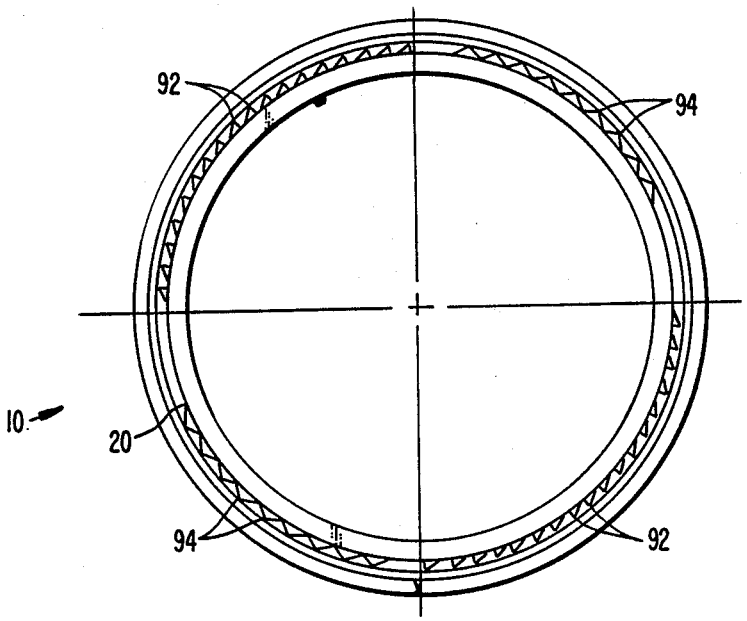
FIG. 8 is a top plan view taken along lines 8—8 in FIG. 3 and showing details of the interlock means on the container finish.

The one- and two-sided ramps 92, 94 may also be seen in FIG. 8. As shown therein, one-sided ramps 92 are located on opposite quadrants from each other and on intermediate quadrants from the two-sided ramps 94. At least two purposes are served by having the two-sided ramp on opposite quadrants and one-sided ramps on the remaining quadrants. First of all, the two-sided ramps permit the container to be removed from the mold after blow-molding with conventional extrusion blow-molding equipment. If the ramps were all one-sided around the finish of the container, the container could not be removed from the mold halves (not shown).

A second fundamental purpose for having two-sided ramps or any kind of ramp is that of centering of the fitment 26 with respect to the finish 20. This centering is accomplished as seen in FIG. 5B by the teeth 90 contacting some portion of the leading or trailing edge walls 96' or 100', respectively. This centering of the fitment with respect to the finish helps to prevent misalignment of the subject parts and thereby assist the sealing system in preventing unwanted leakage of liquid from the container around the parts. It accomplishes this by positioning fitment 14 with respect to finish 20 so that sealing forces are concentrated on the apex of the finish. As best seen in FIG. 1A, finish 20 is centered with respect to fitment 14 to be on a common axis so that annular apex 106 formed by the intersection of beveled surfaces 108, 110 on end wall 22 is on a line of contact. "V" ridge 67 on cup 16 is on the same line of contact due to the dimensional control between outer and inner wall surfaces 82, 84 which results in the cup being on the same common axis with the finish and fitment. In this manner, "V" ridge 67 will be on a direct line of contact with apex 106 with flange 52 sandwiched therebetween.

Figure 9:
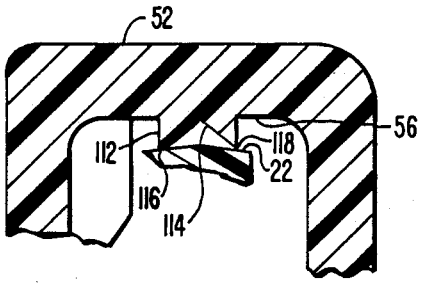
FIG. 9 is an enlarged partial cross-sectional detail view of a first alternate embodiment of the spout fitment.
Figure 10:
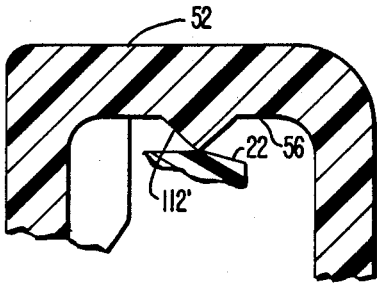
FIG. 10 is an enlarged partial cross-sectional detail view of a second alternate embodiment of the spout fitment.
Figure 11:
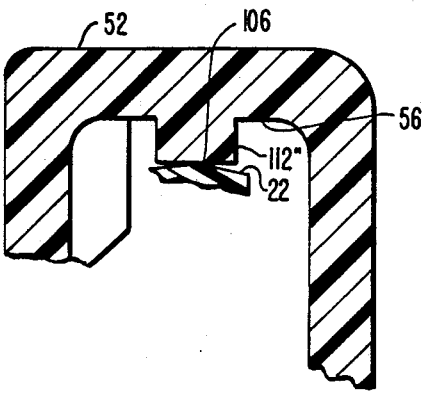
FIG. 11 is an enlarged partial cross-sectional detail view of a third alternate embodiment of the spout fitment.

Turning to FIGS. 9–11, several alternate embodiments are shown wherein a seal bead is added to enhance the sealing effect. FIGS. 9–11 show exemplary bead structures and other structures are also contemplated which provide the necessary sealing function. In FIG. 9 there is shown a bead 112 of generally rectangular cross-section but having a "V" groove 114 in the lowermost portion thereof so as to form a pair of spaced, concentric downwardly directed annular ridges 116, 118. These ridges seal with end wall 22. In FIG. 10 a "V"-shaped annular bead 112 is shown on lower sealing surface 56 of flange 52. This bead 112' sealingly mates with end wall 22 of the finish. Finally, FIG. 11 shows a bead 112" having a generally rectangular cross-section. This bead sealingly contacts apex 106 formed on end wall 22.

It is to be understood that other geometries other than quadrants can be used in locating and separating the teeth and ramps to achieve the desired locking and centering function. For example, other numbers of segments may be utilized and they need not be equal. It is further to be understood that the specific ratio of teeth to ramps described above can be varied as well without eliminating the desired function. Basically, a different number and/or different spacing of teeth to ramps will result in teeth contacting ramp leading or trailing edge walls which will achieve the interlock and centering effect. It is also contemplated that the teeth and/or ramps need not be evenly spaced nor need they be continuous and can be so spaced relative to each other that the contact of teeth with ramps produces the desired interlock and centering function. Some gaps where no teeth or ramps are located will still achieve the function.

It is to be understood that while the invention has been described above in conjunction with the preferred specific embodiment thereof, that the description is intended to illustrate and not limit the scope of the invention, which is defined by the scope of the appended claims.

We claim

1. A package for containing and dispensing liquids comprising:

(a) a container for containing liquids having a hollow body defining a liquid chamber therein and an upwardly directed finish having an opening therein;

(b) a fitment fitted in said opening, said fitment including thereon a frustoconical spout for dispensing liquids therethrough; and (c) interlock and centering means on said finish and fitment for preventing rotation of said fitment with respect to said finish as well as centering said fitment with respect to said finish on a common central axis, said interlock and centering means comprising a plurality of teeth spaced around said fitment projecting radially inwardly interengaging with cooperating ramp projections on said finish projecting radially outwardly substantially entirely around said fitment and finish, wherein said ramp projections have at least one shape, the first shape being a one-sided ramp on said finish and having a leading edge wall making an obtuse angle to a tangent to the side wall of said finish and a trailing edge wall which is radially directed from a tangent to the side wall of said finish, said teeth and one-sided ramps being so dimensioned and positioned such that the teeth will pass over said ramps when said fitment is rotated with respect to said finish in one direction and will be stopped by said trailing edge wall to prevent rotation when rotated in the opposite direction, said ramps further comprising a second shape, said ramps of the second shape being two-sided and having leading and trailing edge walls which join together at an apex each making an acute angle to the radial direction through the apex, said teeth and said two-sided ramps being dimensioned and positioned so that said teeth are adapted to contact said leading and trailing edge walls or said apex of said ramps and thereby to center said finish with respect to said fitment.

2. The invention of claim 1 wherein said teeth and ramps are so spaced and dimensioned relative to each other that the contact of teeth with ramps produces said interlock and centering function.

3. The invention of claim 2 wherein the ratio of the number of ramps to the number of teeth is not equal to one.

4. The invention of claim 3 wherein the ratio of the number of ramps to the number of teeth is 3:2.

5. The invention of claim 1 wherein said finish defines an end wall on the upper end thereof, said end wall comprising a first surface.

6. The invention of claim 5 wherein said first surface comprises a first bevel.

7. The invention of claim 6 wherein said first surface further comprises a second bevel joining said first bevel so as to form an apex.

8. The invention of claim 7 wherein said fitment further comprises a side wall and a generally radially directed flange extending therefrom, a sealing surface on said flange adapted to contact said apex for sealing.

9. The invention of claim 8 wherein said fitment further comprises a side wall surrounding and spaced from said spout, a transition wall connecting said spout with said side wall and forming a drainback channel thereby, and a drain opening in said channel for allowing liquid that collects in said channel to flow back into said liquid chamber

10. The invention of claim 9 further including an annular skirt depending from said fitment flange and having the interior surface thereof in contacting relation with the outer wall of said finish, an annular groove in said outer wall circumscribing said finish, an annular bead fitted within said annular groove so as to provide a mechanical connection between said fitment and finish.

11. The invention of claim 8 wherein said fitment further comprises an annular sealing bead on said sealing surface of said fitment flange.

12. The invention of claim 11 wherein said annular bead is "V" shaped in cross-section.

13. The invention of claim 11 wherein said annular bead is rectangular in cross-section.

14. The invention of claim 11 wherein said annular bead is in the form of a pair of spaced, concentric ridges.

15. The invention of claim 1 wherein said package further comprises a measuring cup having a hollow body with a closed end including engaging means on said cup adapted to cooperatively engage corresponding engaging means on said fitment and finish so that said cup may be selectively engaged therewith and close off communication with said liquid chamber by way of said opening.

16. The invention of claim 15 further including a radially directed cup flange extending from said cup body intermediate said open and closed ends, a depending annular skirt attached to said cup flange and in spaced relation to said cup body, said engaging means on said cup being within said skirt, and an annular ridge on a lower surface of said cup flange contacting and sealing against said fitment when said cup is fully engaged.

17. The invention of claim 16 wherein the body of said cup is of generally cylindrical shape defining inner and outer wall surfaces, said cup being so dimensioned that said outer wall contacts said fitment when said cup is fully engaged, thereby providing centering between said cup and said fitment.

18. The invention of claim 15 wherein said engaging means on said cup, fitment and finish comprise threads.

19. The invention of claim 1 wherein said teeth are oriented in a single direction around said fitment.

* * * * *